US008561844B2

(12) United States Patent
Hagleitner

(10) Patent No.: US 8,561,844 B2
(45) Date of Patent: Oct. 22, 2013

(54) CONTAINER, DISPENSING SYSTEM FOR FLOWABLE PRODUCTS, AND PRODUCTION METHOD

(76) Inventor: Hans Georg Hagleitner, Zell am See (AT)

( * ) Notice: Subject to any disclaimer, the term of this patent is extended or adjusted under 35 U.S.C. 154(b) by 670 days.

(21) Appl. No.: 12/503,548

(22) Filed: Jul. 15, 2009

(65) Prior Publication Data

US 2009/0272752 A1 Nov. 5, 2009

Related U.S. Application Data

(63) Continuation of application No. PCT/AT2007/000559, filed on Dec. 10, 2007.

(30) Foreign Application Priority Data

Jan. 23, 2007 (EP) ..... 07001378

(51) Int. Cl.
*B65D 35/08* (2006.01)

(52) U.S. Cl.
USPC ..... 222/107; 220/680; 156/304.2; 493/210; 493/288

(58) Field of Classification Search
USPC ..... 222/92, 105, 107, 215, 93; 220/613, 220/680; 53/550; 229/5.5; 156/304.3; 383/123–125; 493/210, 237, 308, 288, 493/196, 346
See application file for complete search history.

(56) References Cited

U.S. PATENT DOCUMENTS 3,823,850 A * 7/1974 Holoubek et al. ..... 222/107
4,512,832 A * 4/1985 Rausing ..... 156/86
4,974,753 A 12/1990 Tucker et al.
5,100,030 A 3/1992 Roggenburg, Jr. et al.
5,263,611 A * 11/1993 Trippen ..... 222/105
5,730,694 A 3/1998 Hagleitner
5,887,626 A * 3/1999 Hugo ..... 138/89
(Continued)

FOREIGN PATENT DOCUMENTS

EP 0 992 438 A1 1/2000
EP 1 248 549 A1 10/2002
(Continued)

OTHER PUBLICATIONS

International Search Report, dated Aug. 28, 2008.

*Primary Examiner* — Paul R Durand
*Assistant Examiner* — Robert Nichols, II
(74) *Attorney, Agent, or Firm* — Laurence A. Greenberg; Werner H. Stemer; Ralph E. Locher

(57) ABSTRACT

A container of a flexible material web of weldable plastic. A reinforcing element is attached on the exterior of a wall of the container. The container may be formed by drawing a flat material web of weldable plastic material over a core tube and welding a longitudinal seam for closing the flat material web to form a tube. A reinforcing element is welded on an exterior of the tube while employing the core tube as an internal cooperating support. The tube is divided and separated along transverse seams into cut-off containers to form the containers. A dispensing system for flowable products includes at least one of the containers and a dispenser provided with a container receiving device for holding the container without closure. The container is formed with sliding guide and a displaceable closure, which is preferably opened when the container is placed on the receiving device.

7 Claims, 6 Drawing Sheets

(56) References Cited

U.S. PATENT DOCUMENTS

| | | | | |
|---|---|---|---|---|
| 5,993,720 | A * | 11/1999 | Konuma et al. | 264/263 |
| 6,419,117 | B1 * | 7/2002 | Bosch | 222/1 |
| 6,578,738 | B1 | 6/2003 | Keller | |
| 6,758,372 | B2 | 7/2004 | Studer et al. | |
| 6,805,261 | B1 | 10/2004 | Laudenberg | |
| 7,044,333 | B2 * | 5/2006 | Johns et al. | 222/92 |

FOREIGN PATENT DOCUMENTS

| | | | |
|---|---|---|---|
| WO | 9316928 | A1 | 9/1993 |
| WO | 95/09111 | A1 | 4/1995 |
| WO | 01/26988 | A1 | 4/2001 |

* cited by examiner

CONTAINER, DISPENSING SYSTEM FOR FLOWABLE PRODUCTS, AND PRODUCTION METHOD

CROSS-REFERENCE TO RELATED APPLICATION

This is a continuation, under 35 U.S.C. §120, of copending International application No. PCT/AT2007/000559, filed Dec. 10, 2007, which designated the United States; this application also claims the priority, under 35 U.S.C. §119, of European patent application No. EP 07001378.4, filed Jan. 23, 2007; the prior applications are herewith incorporated by reference in their entirety.

BACKGROUND OF THE INVENTION

Field of the Invention

The invention concerns a container formed from a flexible material web of weldable plastic material and having a wall with which there is associated a reinforcing element that engages over preferably oppositely disposed edges of the container, a process for the production of the container and a dispenser system for products which are capable of flowing comprising a dispenser and at least one container.

Containers of that kind are used for example for products which are capable of flow, for example soap or the like, in dispensers, and, after the content is used up, are thrown out or recycled, or at any event are not refilled. The containers are therefore produced in such a way as to save as much material as possible and are welded from thin plastic films, stability being achieved by reinforcing elements which are provided only at the required regions.

A container of that kind is described, for example, in international patent publication WO 01/26988. There, the flexible material web is folded lengthwise so that an approximately U-shaped cross-section is formed, and divided by transverse welds into mutually attached, upwardly open hollow bodies which are then individually separated in a severing device. A hole is then punched in the bottom region and the reinforcing portion which engages over the edges and which is also approximately U-shaped, having a discharge connection, is positioned under the hole. The reinforcing portion is fixed to the container by way of an internal anchoring sleeve which is introduced from above through the hollow body and which has a flange supported internally against the hollow body and is screwed through the hole in the bottom region into the discharge connection. The internal flange and the reinforcing portion sealingly clamp the material web in position. The hollow body is then filled with the product and the open side is finally welded.

European published patent application EP 0 992 438 A (cf. FIG. 1) shows a bottle-like container comprising a thin flexible material web, the open neck region of which is pulled through a reinforcing bottom outlet provided with a tubular connecting stub, and folded back externally around the tubular connecting stub. A sealing and clamping ring has an annular groove and is pushed onto the tubular connecting stub covered with the neck region, wherein the connection to the bottom outlet is afforded by a sleeve which internally and externally clamps on the tubular connecting stub. The outlet opening of the container, which is constricted by the internal sleeve, is closed by a usual plug or the like, which can be pulled out on the common axis of the container neck and the sleeves.

International patent publication WO 95/09111 discloses a further container having a stiff bottom portion and a stiff cover portion having a closure and a flexible tubular wall portion, into which are welded the bottom portion and the cover portion which each have a respective flange to permit welding.

International patent publication WO 93/16928 also involves a container comprising a flexible material which, similarly to the above-mentioned WO 01/26988, has a reinforcing portion which carries the closure and which is welded from the interior to the corresponding wall region having an opening.

SUMMARY OF THE INVENTION

It is accordingly an object of the invention to provide a container, which overcomes the above-mentioned disadvantages of the heretofore-known devices and methods of this general type and which provides for the production of a container of the kind set forth above in the simplest possible fashion.

The primary object is achieved in that the reinforcing element is externally fixed to the wall of the container. This expression is used to denote that the reinforcing element is connected exclusively to the outside. As it involves a closeable material web, the reinforcing element is preferably also of a weldable plastic material and is welded from the exterior onto the material web. Alternatively the reinforcing element could also be glued in position over the full surface area involved.

With the foregoing and other objects in view there is therefore provided, in accordance with the invention, a container, comprising:

a flexible material web of weldable plastic material formed into a welded container body with walls;

a reinforcing element externally fixed to a wall of said welded container body, and preferably engaging over oppositely disposed edges of said container.

In accordance with an alternative embodiment, the container according to the invention comprises:

a wall having an opening formed therein;

a displaceable closure covering said opening in said wall and engaging with a sliding guide extending in a sliding direction on the container; and at least one coding element extending beside said sliding guide.

In this second embodiment as well, there may be provided a reinforcing element disposed to reinforce said wall formed with said opening and engaging over oppositely disposed edges of the container; a sliding guide and at least one coding element may be provided at the reinforcing element.

With the above and other objects in view there is also provided, in accordance with the invention, a method of producing a container as noted above. The method comprises the following steps:

drawing a flat material web of weldable plastic material over a core tube and welding a longitudinal seam for closing the flat material web to form a tube;

welding a reinforcing element on an exterior of the tube and thereby employing the core tube as an internal cooperating support; and dividing the tube along transverse seams into cut-off containers to form containers according to the above summary.

In addition, the method includes forming an opening in the flat material web prior to forming the tube and then, subsequent to forming the tube, welding a connecting stub on from the exterior in the region of the opening such that the opening is accessible through the connecting stub.

In other words, the above-mentioned desirable simplification is achieved by the elimination of any operation or action in the interior of the container, which in accordance with the state of the art includes either introducing and fitting the anchoring element or introducing and passing through the entire reinforcing portion. That is possible by virtue of the fact that the step of applying the reinforcing portion is effected at a time and at a location at which the core tube required as a counterpart support for the longitudinal seam welding operation, in the interior of the tube, can also be used as a counterpart support for fixing the reinforcing portion. If the container is to have an in particular closable opening, it is preferably provided that the flat material web be provided with an opening prior to the operation of shaping into a tubular configuration, and, after the tubular shaping operation, a closable reinforcing element provided with a connecting stub is welded in position in the region of the opening from the exterior in such a way that the opening is accessible through the connecting stub.

As already mentioned hereinbefore, in the case of very thin-wall containers of this kind, reinforcement is required only in certain areas or regions, for example in the region of the opening. In that case a closure for the opening is preferably provided on the reinforcing portion, in particular on the connecting stub projecting from the reinforcing portion. When the containers are filled with soap or the like, which is discharged by means of a dispenser, it is preferably provided that the wall provided with the externally fixed reinforcing element forms a base standing surface of the container. The reinforcing element is required for a container which in use is upside down, in particular also so that even residues of the content, which without a reinforcing element would collect in outward bulge portions or corrugation configurations around an opening which in that case is then higher can also flow out.

A container according to the invention can be fitted into a dispenser if the region of the container, surrounding the opening, is compatible with a container receiving means of the dispenser. That is thus a prerequisite in order to be able to use the container at all, but it involves the disadvantage that all containers of the same configuration or at least all containers with regions of the same configuration around the opening can be fitted without a container involving the wrong content being conspicuously noticeable. By way of example it would be possible for any smooth cylindrical container neck to be fitted into a smooth cylindrical socket of the container receiving means, of appropriate diameter. That matching relationship is also referred to as coding, in which respect it is possible to establish various degrees of coding arising out of the number of cooperating coding elements. The simplest coding represents for example the above-specified cylindrical shape of the container neck and the receiving socket. If one of the two parts is not round then they do not fit together.

As however it is desirable or also necessary for given dispensers to be filled only with given containers, more complicated codings are used, for example an axis-parallel rib with matching groove in accordance with U.S. Pat. No. 5,100,030 or two or more pairs of similar coding elements in accordance with European patent EP 1 248 549.

A container according to the invention preferably has the sliding closure known from the above-mentioned international publication WO 95/09111. Projecting upwardly from the cover portion of the container is a container neck in the form of a connecting stub, from which a respective leg of a sliding guide projects on each side parallel to the end face, onto which a clip-like C-shaped portion is pushed as a closure, engaging behind the legs. The container receiving means on the dispenser or the like is of the same configuration as the closure, that is to say there are portions engaging behind the legs projecting from the connecting stub. That makes it easier to change the container as a fresh container can be fitted to the container receiving means and pushed thereinto without the closure having to be previously removed. That is advantageous in particular if the container is used upside down as the content cannot flow out or no additional measures are necessary to prevent that. As soon as the closure bears against the sliding guide the container can be displaced and the legs of the connecting stub slide into the container receiving means, in which case finally the closure is released and falls off.

In order now to provide a higher degree of coding in the case of a sliding guide, at least one first additional coding element is provided preferably on the container, in particular on the reinforcing element, the coding element including for example a leg extending parallel to the sliding guide. At least one groove or recess extending in the sliding direction is provided in matching relationship with the leg of the additional coding element, on the container receiving means of the dispenser. Legs and grooves can also be interchanged or combined, that is to say two legs can enclose a groove and a leg can extend between two grooves. It is further also possible for a coding element to extend around over half the sliding length and to be continued in identical opposite relationship in the other half.

The depth of insertion can be limited by a transverse leg which is provided on the container receiving means at the end of the sliding guide or on the container and which forms an abutment. If the transverse leg is provided on the container, there is no need for rotation of the bottle through 180°. This can be of significance if for example writing on the inserted container is to be readable. In that case the writing is provided at the side of the transverse leg.

Other features which are considered as characteristic for the invention are set forth in the appended claims.

Although the invention is illustrated and described herein as embodied in a container, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 5:
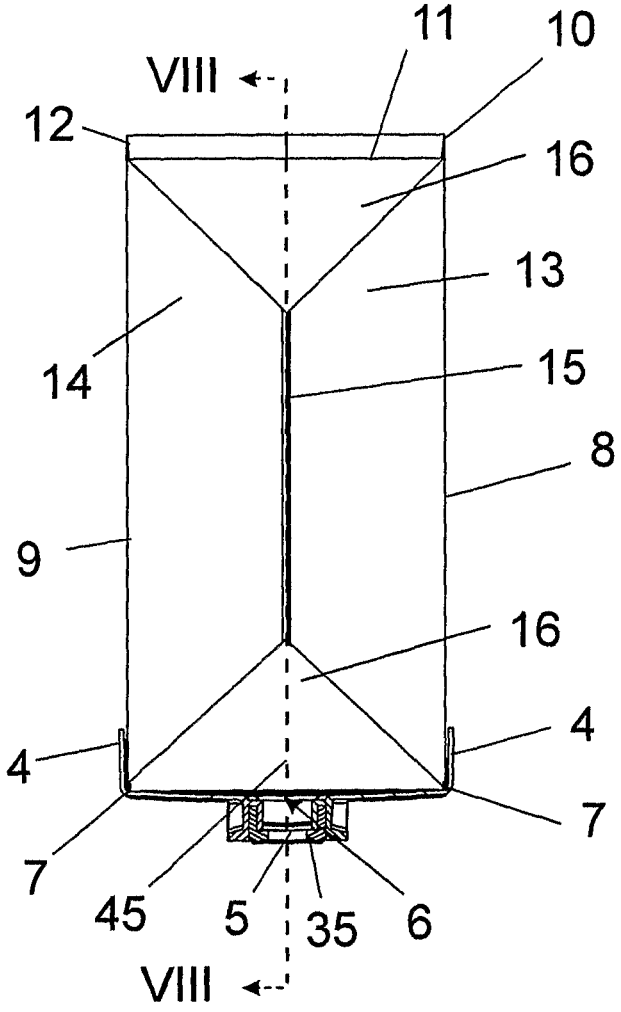
FIG. 5 shows a section taken along line V-V in FIG. 3.
Figure 6:
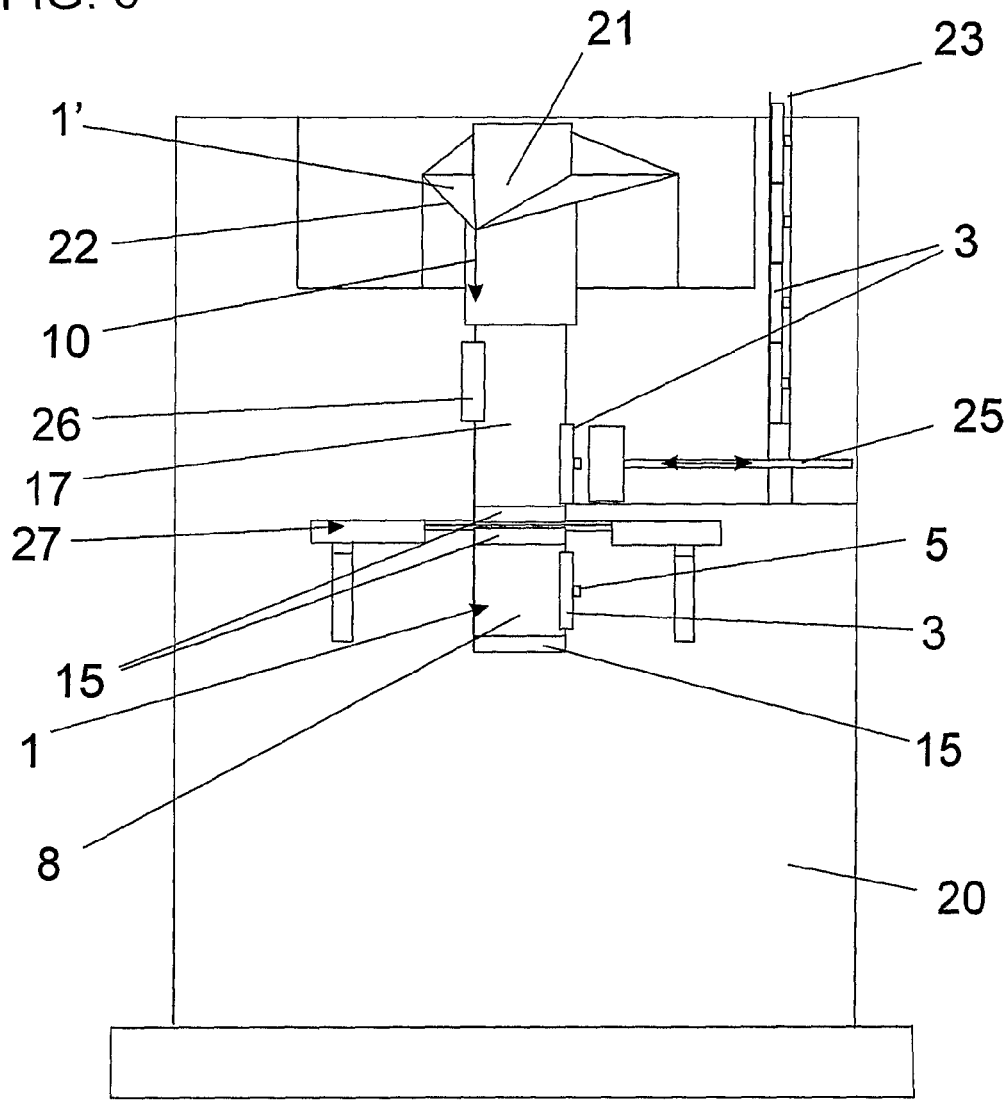
FIG. 6 shows a diagrammatic front view of a production apparatus.
Figure 7:
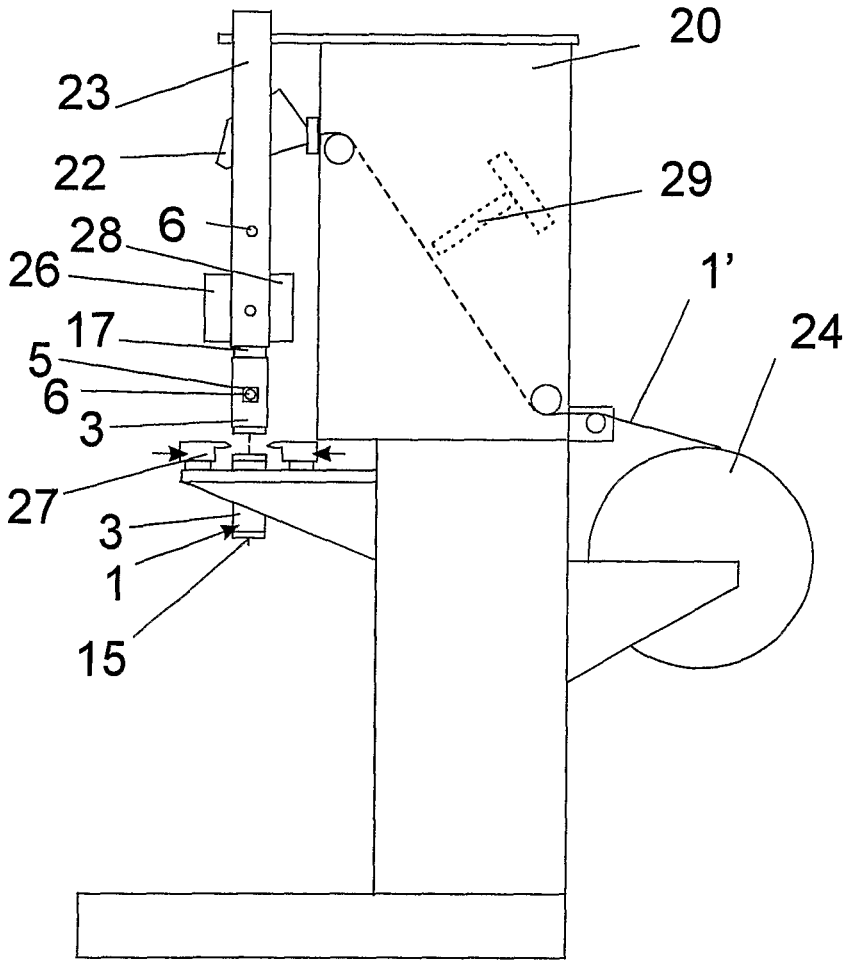
FIG. 7 shows a diagrammatic side view of the production apparatus.

Referring now to the figures of the drawing in detail and first, particularly, to FIGS. 1-5 thereof, there is shown a container 1 of soft flexible material, for example thin plastic film. The container 1 is approximately parallelepipedic and at a wall 2 has an opening 6 onto which a reinforcing element 3 is welded only from the exterior, the reinforcing element 3 being provided with a sealingly closable connecting stub or connecting portion 5 associated with the opening. As can be seen from the section in FIG. 5, the reinforcing element 3 extends over a large part of the area of the wall 2 and with side legs 4 embraces two oppositely disposed edges 7 of the container 1, which are formed with side walls 8 and 9. The side wall 8, the wall 2 with the opening 6, the side wall 9 and the wall 11 opposite the wall 2 are produced by longitudinal folding of a flat material web 1' (FIGS. 6 and 7) which is closed at the transition from the side wall 8 to the wall 11 by a connecting welded seam 10 to afford a tube 17 (FIGS. 6 and 7). The wall 11 opposite the wall 2 is provided with a reinforcing welded seam 12 at the edge blending into the side wall 9 so that, in the finished container 1, as shown in FIG. 5, the wall 11 is set in with respect to the edges of the seams 10 and 12.

The container 1 is provided in particular for accommodating liquid soap or the like and can be fitted for example in a dispenser in an upside down position so that the wall 2 having the opening 6 and the reinforcing element 3 forms the container bottom or the base side on which it stands. If the container 1 is used with the opening 6 upwardly, the two welded seams 10 and 12 in opposite relationship to the reinforcing element 3 serve for stiffening and reinforcing the wall 11 which then forms the bottom.

By virtue of its manufacture from a flat material web 1' or from a tube 17 triangular pockets 16 must be shaped to form the last two side walls. In that case the pockets 16 are inwardly folded flap portions of the walls 2 and 11 and the last two side walls are produced by folding in flap portions 13, 14 of the side walls 8 and 9, which are connected by way of welded seams 15. The pockets 16 can also be welded, whereby the stability of the container 1 is increased and it is made easier for the entire contents to flow out of same.

Figure 1:
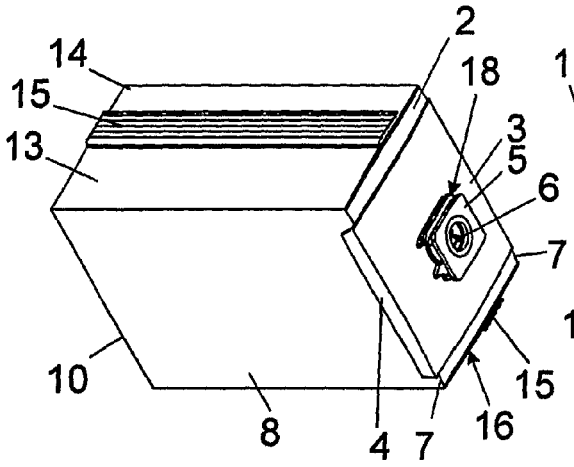
FIG. 1 is a perspective view of a container according to the invention.
Figure 2:
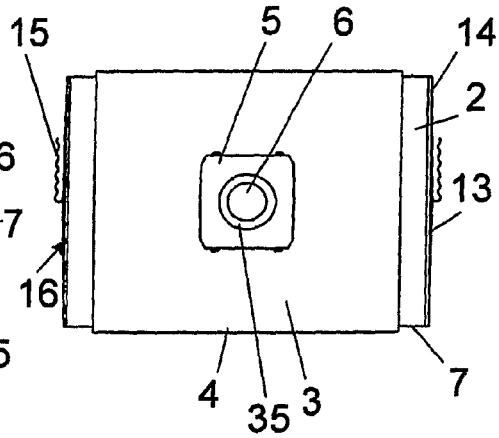
FIG. 2 is an elevation view of the side with the reinforcing element.
Figure 3:
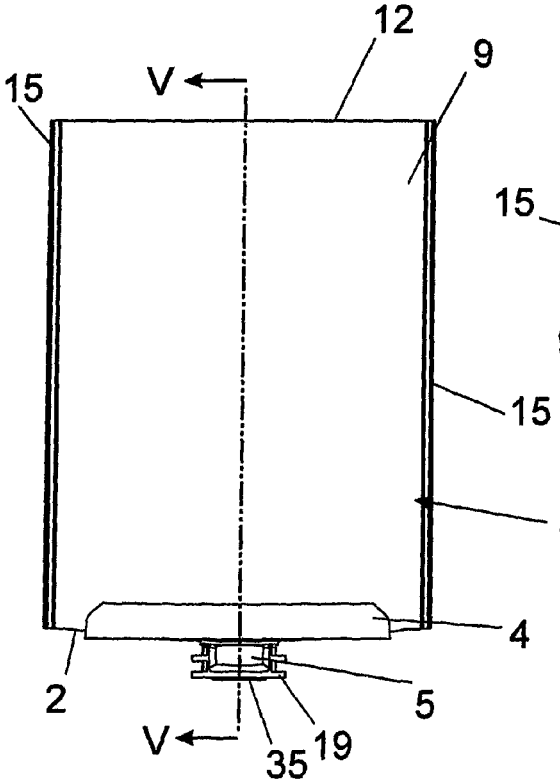
FIGS. 3 and 4 show side views in an upside down position.
Figure 4:
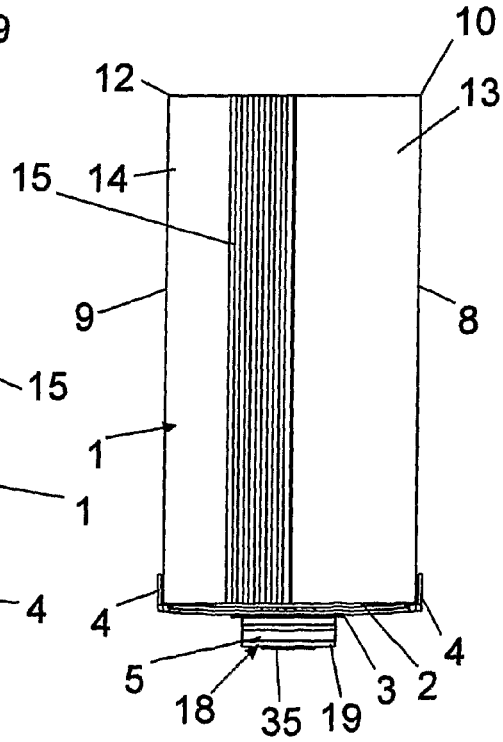

FIG. 1 shows a perspective view of the container 1 in a recumbent position with the welded seams 15 disposed upwardly and downwardly. That therefore substantially corresponds to the delivery position from a production apparatus 20 as shown in FIG. 6.

The production apparatus 20 shown in FIGS. 6 and 7 has a tube or chute 21 which forms a shaping core and to which a flat material web 1' is fed from a roll 24. The material web 1' passes by way of a shaping shoulder 22 to the core tube 21 and is closed therearound to constitute a tube 17, in which case it passes a longitudinal welding device 26 whose cooperating holder is formed by the core tube 21 and which produces the connecting welded seam 10 along an edge of the container 1. A second longitudinal welding device 28 produces the reinforcing welded seam 12 at the opposite container edge. Provided laterally is a magazine 23 for reinforcing elements 3, from which a respective reinforcing element 3 is passed laterally to the tube 17 by means of a transverse displacement and welding device 25 and is welded onto the tube 17 from the exterior, the core tube 21 being used as an internal cooperating holder. A transverse welding device 27 arranged beneath the core tube 21 closes the tube 17 by means of two transverse seams 15. A cutting device is associated with the transverse welding device 27 for cutting off the tube 17 between the two transverse seams 15 (FIG. 7) so that a filled container 1 is ejected and the next container to be filled is closed. FIG. 6 shows only the rear half of the transverse welding device 27 in order to show the operation of cutting off the container 1.

Furthermore an additional device is preferably associated with the transverse welding device 27. After the two transverse seams 15 have been welded and after the cutting-off operation, the additional device folds over the two upstanding welded strips so that, as can be seen in particular from FIG. 2, they are parallel to the side walls formed from the flap portions 13 and 14. As the material is still warm immediately after the welding operation, the transverse seam strips already cool down in the folded-over position so that they do not project from the container 1 in such a way as to be a problem. If the container 1 is already filled with the product in manufacture by way of the core tube that promotes rapid cooling of the folded-over strips.

Figure 8:
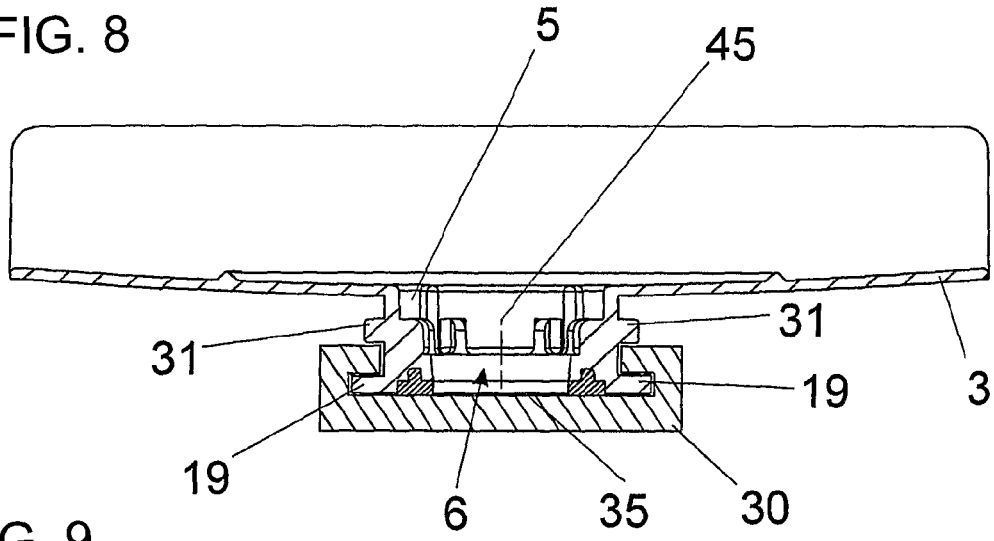
FIG. 8 shows a section taken along line VIII-VIII in FIG. 5 through the reinforcing element provided with a closure, but without the container per se.
Figure 9:
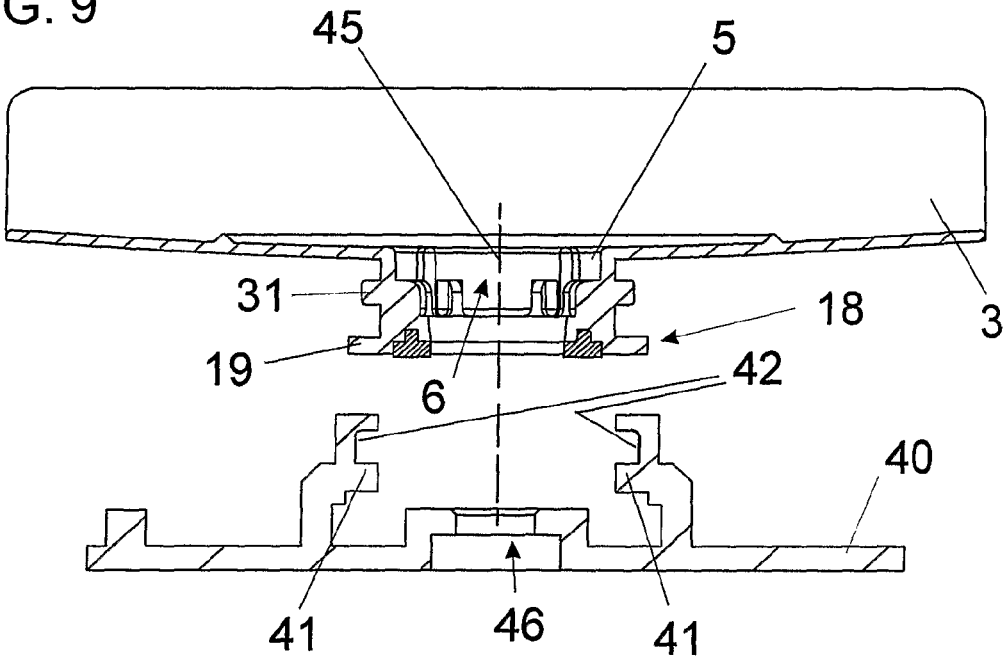
FIGS. 9 and 10 show the view of FIG. 8 in a confronting relationship with and in a position of connection to a container receiving means of a dispenser.

If the container 1 is to have an opening 6 provided with an openable closure 30 (FIG. 8), holes are stamped in the material web 1' in a row at predetermined locations by means of a stamping device 29, the holes later each forming the opening 6 of a container 1. The reinforcing elements 3 to be welded onto the tube 17 are in that case respectively provided with a connecting stub 5 which comes to lie on the axis 45 (FIG. 5) over one of the holes stamped in the tube so that the opening 6 in the finished container 1 is accessible through the connecting stub 5. The connecting stub 5 carries legs 19 projecting at both sides in a position of prolonging its end face and a sealing ring 35 projecting slightly from the end face. The closure 30 which is a substantially clip-shaped or C-shaped body can be pushed on from the side, in which case it engages behind the legs 19.

Figure 10:
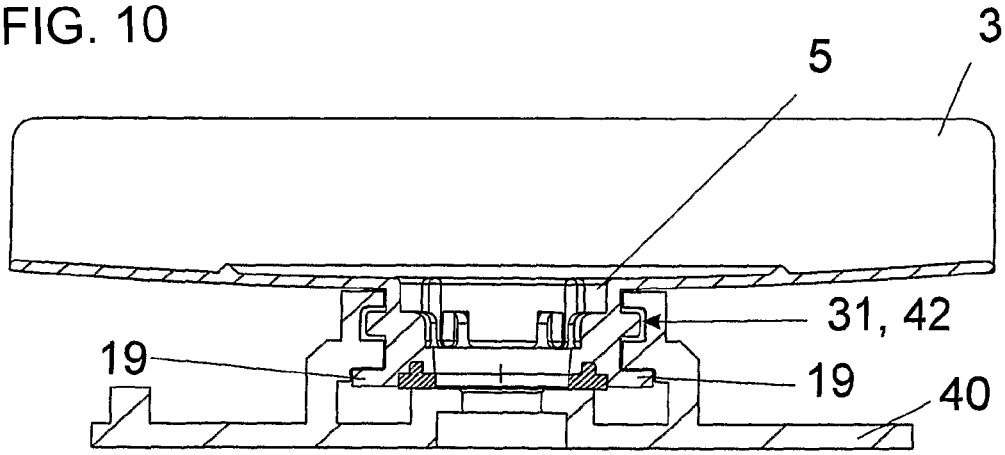
Figure 11:
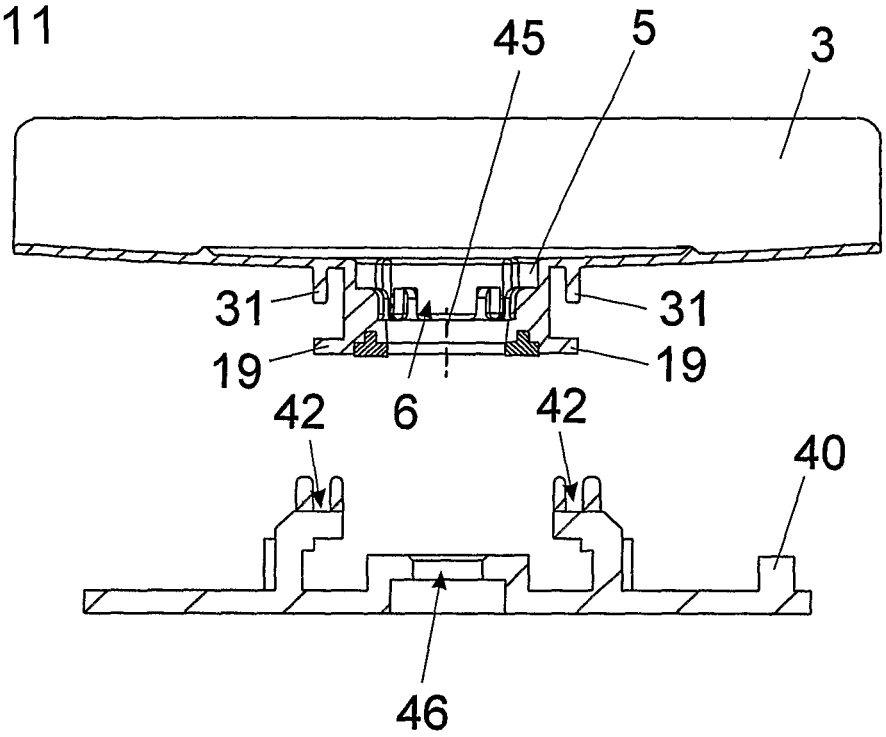
FIGS. 11 and 12 show a second embodiment similar to FIG. 8 in confronting relationship with and in a position of connection to a container receiving means of a dispenser.
Figure 12:
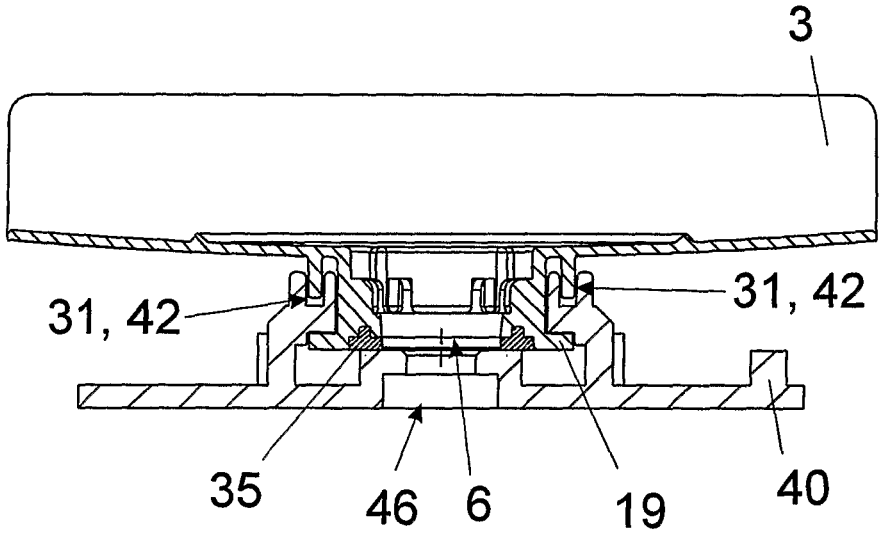

The formation of a sliding guide 18 on the connecting stub 5 simplifies insertion of the container 1 into a dispenser of which FIGS. 9 through 12 show only the single element which is primarily important for that purpose, namely the container receiving means 40. It has an opening 46 which, when the container 1 is inserted and sealed by the sealing ring 35, is aligned with the connecting stub 5 and the opening 6 of the container 1 (FIGS. 10 and 12). The container receiving means 40 is of a configuration like the closure 30 and with ribs 41 engages behind the legs 19 of the connecting stub 5. If the container 1 is to be fitted into the container receiving means it is applied with the closure 30 laterally and then pushed into the receiving means, in which case the closure 30 becomes free. In order now to ensure that only suitable containers or containers 1 with suitable contents can be fitted into certain dispensers, there is provided a coding, that is to say on the containers 1, in particular the reinforcing elements 3, and on the container receiving means 40, there are coding elements 31, 42 which extend in the sliding direction and which are in the form of legs, ribs, grooves or recesses and which match each other in complementary relationship only in given combinations. That substantially precludes the insertion of incorrect containers 1. The insertion depth can be limited by a transverse leg (not shown) or the like on the container receiving means 40 or on the container 1.

The invention claimed is:

1. A substantially parallelepipedic container, comprising:

a flat flexible material web of weldable plastic material having two longitudinal margins, said web being formed into a welded container body with walls, said longitudinal margins being connected by a welded seam;

a wall of said container body having an opening formed therein, said wall extending parallel to said welded seam; and a reinforcing element provided with a closable connecting stub, said reinforcing element being fixed exclusively to an outside of said wall with said stub being in line with said opening, and said reinforcing element engaging over two opposite edges of said wall that extend parallel to said welded seam.

2. The container according to claim 1, wherein said welded seam is provided along a third edge of the container, said third edge being parallel to said two opposite edges.

3. The container according to claim 1, wherein said wall provided with said reinforcing element forms a base stand surface of the container.

4. The container according to claim 1, which comprises a compressible sealing ring projecting slightly at an end of said connecting stub.

5. The container according to claim 1, wherein said connecting stub has an axis and a sliding guide extends perpendicularly to said axis for a displaceable closure.

6. The container according to claim 5, wherein said sliding guide has mutually opposite legs projecting on both sides from said connecting stub parallel to an end thereof and said first coding element is disposed parallel to said legs of said sliding guide on said reinforcing element.

7. A method of producing a container having an opening in a wall thereof, the method which comprises:

drawing a flat material web of weldable plastic material which is provided with the opening formed therein over a core tube and welding a longitudinal seam for closing the flat material web to form a tube;

welding a reinforcing element having a connecting stub on an exterior of the tube in such a way that the opening is accessible through the connecting stub and thereby employing the core tube as an internal cooperating support; and dividing the tube along transverse seams into cut-off containers to form containers according to claim 1.

* * * * *